US006174005B1

(12) United States Patent
Norton

(10) Patent No.: US 6,174,005 B1
(45) Date of Patent: Jan. 16, 2001

(54) BI-DIRECTIONAL HANDLE AND LATCH ASSEMBLY

(75) Inventor: Paul Norton, Mission Viejo, CA (US)

(73) Assignee: Sierra Pacific Engineering and Products, Rancho Dominguez, CA (US)

( * ) Notice: Under 35 U.S.C. 154(b), the term of this patent shall be extended for 0 days.

(21) Appl. No.: 09/345,284

(22) Filed: Jun. 30, 1999

(51) Int. Cl.[7] ..... E05C 1/12

(52) U.S. Cl. ..... 292/169.21; 292/169; 292/336.3; 292/165

(58) Field of Search ..... 292/173, 165, 292/169, 169.14, 169.15, 169.16, 169.21, 169.22, 170, 336.5, DIG. 52, 163, 347

(56) References Cited

U.S. PATENT DOCUMENTS

| | | | | |
|---|---|---|---|---|
| 180,239 | * | 7/1876 | Jennings . | |
| 1,104,460 | * | 7/1914 | Wesolowski | 292/169.21 |
| 1,619,789 | * | 3/1927 | Vogt | 292/169.21 |
| 1,782,386 | * | 11/1930 | Moore et al. | 292/169.21 |
| 1,858,608 | * | 5/1932 | Wilson | 292/169.21 |
| 2,307,110 | * | 1/1943 | Chesler | 292/169.21 |
| 2,382,663 | * | 8/1945 | Quigley et al. | 292/169.21 |
| 2,615,744 | * | 10/1952 | Colonna | 292/169.21 |
| 4,982,986 | * | 1/1991 | Gressett, Jr. et al. | 292/336.3 |
| 5,433,495 | * | 7/1995 | Uffner | 292/169 |
| 6,030,008 | * | 2/2000 | Chang | 292/1.5 |

* cited by examiner

*Primary Examiner*—Teri Pham
(74) *Attorney, Agent, or Firm*—Cislo & Thomas LLP

(57) ABSTRACT

A bi-directional handle and latch assembly mountable to a door or other closure. The latch assembly may be operated by either of a first handle or a second handle. The first handle may operate a latch bolt in the latch assembly by rotating the handle in either the clockwise or the counter-clockwise direction, and operate the latch bolt irrespective of whether or not the second handle is locked. The invention employs a simple construction for ease of manufacture, repair, and replacement of the first handle with other handles with different aesthetic or functional outer designs or configurations.

5 Claims, 3 Drawing Sheets

BI-DIRECTIONAL HANDLE AND LATCH ASSEMBLY

BACKGROUND OF THE INVENTION

This invention relates to handle and latch assemblies and other closure mechanisms and, in particular, to a latch assembly having a latch bolt and a first handle that may operate the latch bolt by rotating the handle in either the clockwise or the counter-clockwise direction with an economy of manufacturing expense and parts. This first handle may operate the latch bolt irrespective of whether a second handle, which may operate the latch from the opposite side of the door or closure, is locked or unlocked.

Typically, door latches may be engaged from the inside and from the outside of the door by handles of various configurations and operation. Some door latches may be engaged by a first handle by rotating the handle in either the clockwise or the counter-clockwise direction.

Still other door latches allow for a second handle, an outside handle for instance, that may also operate the door latch but may also be locked and thereby precluded from operating the door latch. In some of these latch configurations, the door latch may still be operated by the first handle, despite the second handle remaining in a locked state.

These various door latch assemblies suffer from intricate configurations and a multiplicity of mechanical parts. The manufacturers of these various door latch assemblies have to produce many internal inter-linking components. Additionally, with this multiplicity of inter-linking components comes the associated multiplicity of points for mechanical failure of the door latch assembly.

BRIEF SUMMARY OF THE INVENTION

This invention relates to a handle and latch assembly or other secure and release closure device. The latch assembly may be operated by either of a first handle or a second handle. The first handle may be a handle, knob, lever, gear device, or other release mechanism which operates a latch bolt contained within the latch assembly by rotating the handle or other release mechanism in either the clockwise or the counter-clockwise direction. The first handle or other release mechanism may operate the latch bolt irrespective of whether or not the second handle, knob or release mechanism is locked or otherwise restrained from rotating.

In view of the above-mentioned problems and inconveniences, as well as other such problems that are inherent in such current door latch assemblies, this invention has been devised in order to minimize the expense of manufacturing, the number of components manufactured, and the accompanying number of points for mechanical failure during operation.

It is an object of the present invention to provide a handle and latch assembly or other release mechanism that allows for operation by rotating a first handle or other release device in either the clockwise or the counter-clockwise direction. It is another object of the present invention to allow for this bidirectional operation of the latch assembly or release mechanism by the first handle irrespective of whether or not a second handle or other release device is locked or otherwise inoperative. It is still a further object of the present invention to provide a handle and latch assembly or other release mechanism that is simple in construction, involving an economy of components, manufacture and assembly, and involving ease of repair of the same if necessary. It is still a further object of the present invention to provide a handle and latch assembly or release mechanism that allows for ease of interchangeability between the first handle and other handles, knobs, levers, gearing mechanisms, or other release devices depending on the desired aesthetic design or functional outer configuration.

These and other objects and advantages of the present invention will be apparent from a review of the following specification and accompanying drawings.

DETAILED DESCRIPTION OF THE INVENTION

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
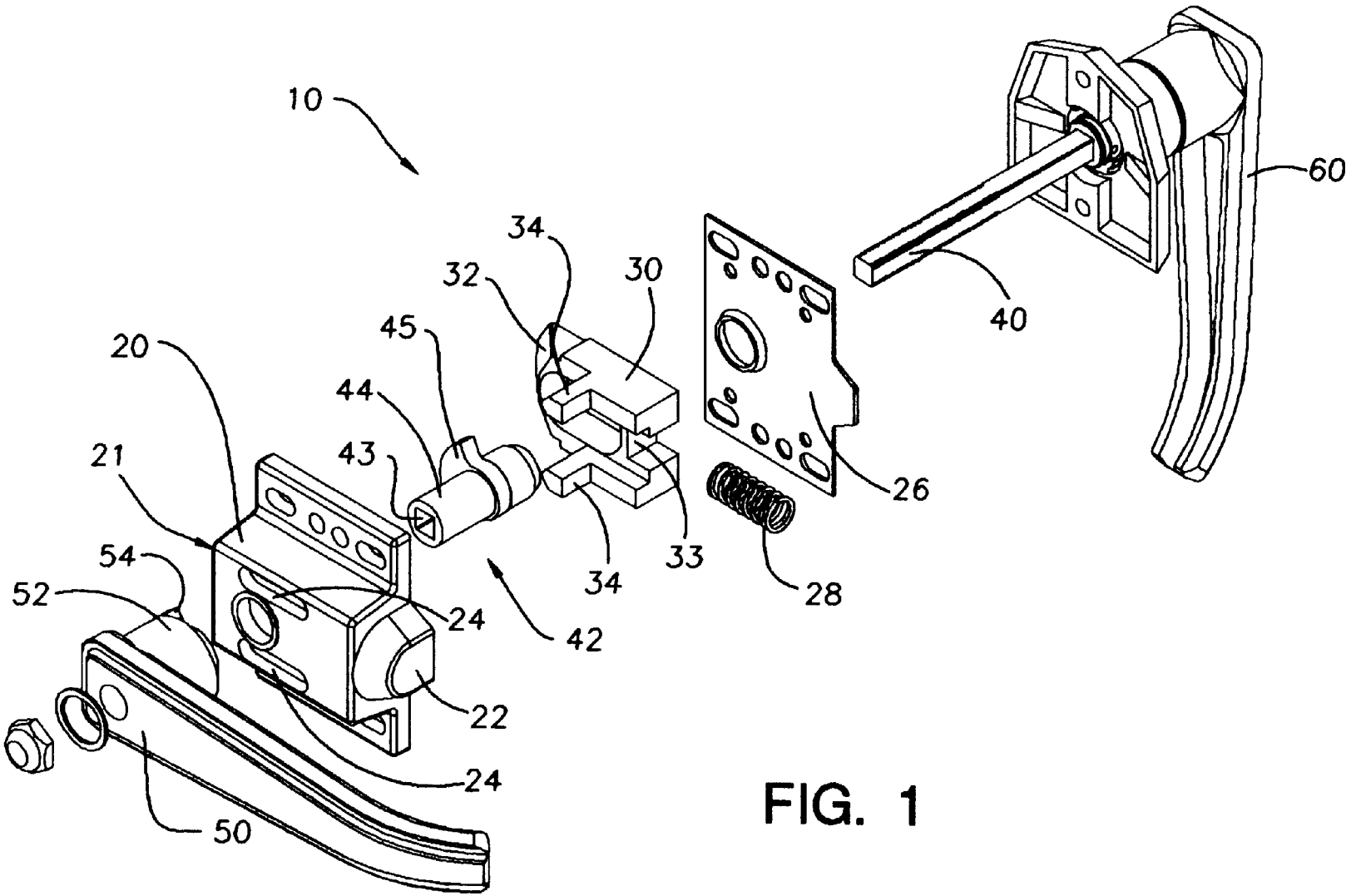
FIG. 1 is an exploded perspective view of one embodiment of a handle and latch assembly.

Referring first to FIG. 1, the present invention relates to a closure mechanism or latch assembly 10 mountable to a door or other closure structure. The latch assembly 10 is comprised of a latch housing or brace 20, a latch bolt 30, a biasing means 28, a shaft 40, and a shaft collar assembly 42. For ease of manufacture and assembly, the latch housing or brace 20 includes a pair of housing halves 25 and 26 adapted to be matingly assembled. The latch bolt 30 is a sliding member with a locking portion or lateral structure 32 and recess surface or other catch structure 33 contained in part within the latch housing 20 and may be engaged and operated by either a first handle 50 or a second handle 60. Either handle may just as easily be a knob, lever, or other release mechanism adapted to engage the latch bolt 30 and cause the latch bolt 30 to move between a first latch bolt position and second latch bolt position.

Figure 2A:
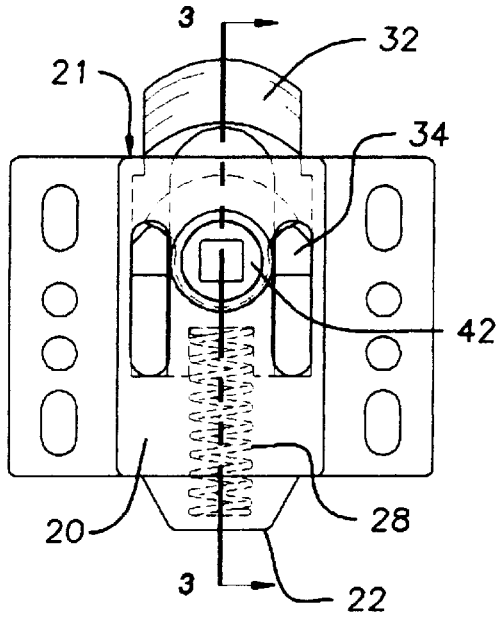
FIG. 2*a* is a plan view of a latch assembly according to the invention in a first latch bolt position in which a locking portion of the latch bolt extends outward from the housing of the latch assembly mechanism.
Figure 2B:
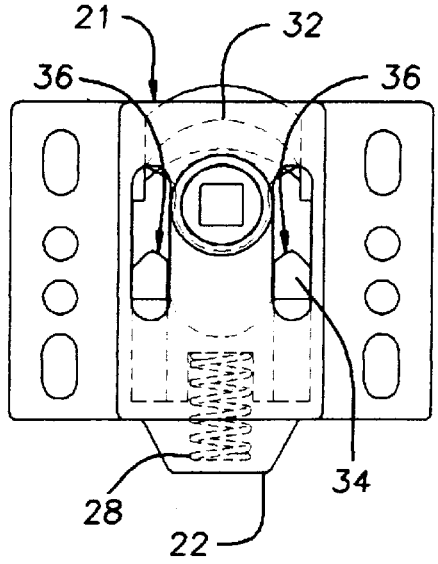
FIG. 2*b* is a plan view of the latch assembly in a second latch bolt position in which the locking portion of the latch bolt is substantially retracted within the latch assembly housing through the engagement of the latch bolt by the cam surface on the first handle (not shown).
Figure 3:
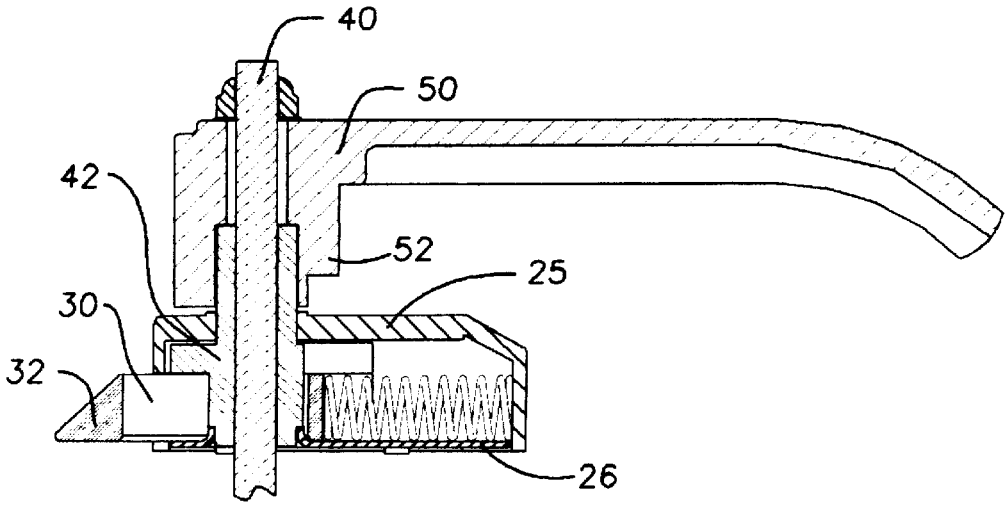
FIG. 3 is a sectional view of the latch assembly mechanism in the first latch bolt position taken from line 3—3 of FIG. 2*a*.

The latch brace or housing halves 25 and 26, when assembled, form at least one opening 21 through which the lateral structure 32 of the latch bolt or sliding member 30 can move between said first and second latch bolt positions. In the first latch bolt position, the lateral structural 32 of the latch bolt 30 laterally extends out through the at least one opening 21 of the latch housing 20, as shown in FIG. 2*a*. FIG. 3 shows a sectional view of the latch assembly 10 in the first latch bolt position. In the second latch bolt position, the lateral structure 32 of the latch bolt 30 is substantially retracted within the latch housing 20, as shown in FIG. 2*b*. Biasing means 24 causes the latch bolt 30 to be biased to the first latch bolt position. FIG. 1 illustrates a compression spring as a contemplated biasing means, compressed between a recessed surface 33 of the latch bolt 30 and the back wall 22 of the latch housing 20. Other biasing means contemplated by this invention include a tension spring, a leaf spring, a torsion spring, a pneumatic device, a magnetic or electrostatic device, or gravity, or other mechanism consistent with the inventive concept of this invention.

Figure 4:
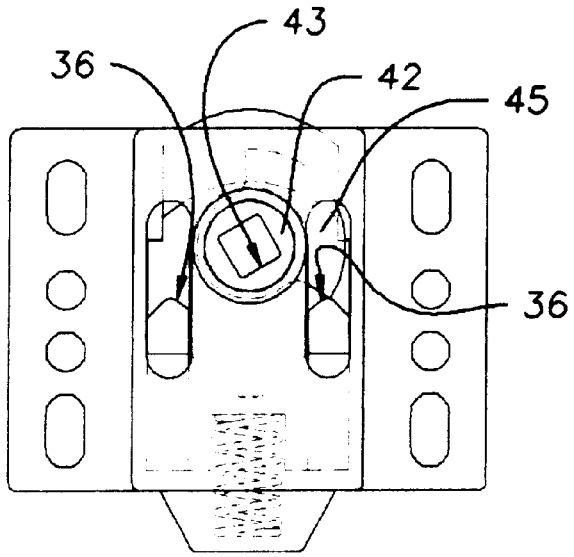
FIG. 4 is a plan view of the latch assembly in the latch bolt second position, substantially as shown if FIG. 2*b*, except that the locking portion of the latch bolt is substantially retracted within the latch assembly housing through the engagement of latch bolt by the cam surface on the shaft collar.

The latch bolt 30 further contains one or more engagement pins or positioning levers 34 that may be engaged by a first cam or first actuator assembly 52 on the first handle 50, as shown in FIG. 4. The placement of the engagement pins 34 in relation to the first cam or actuator assembly 52 allows the latch bolt 30 to be operated by rotating said first handle 50 in either the clockwise or the counter-clockwise direction. By rotating the first handle 50 around a common axis, the first cam or actuator assembly 52 variably presses up against mating surface 36 of one or the other engagement pins 34 thereby forcing the latch bolt 30 toward the second latch bolt position.

Figure 5:
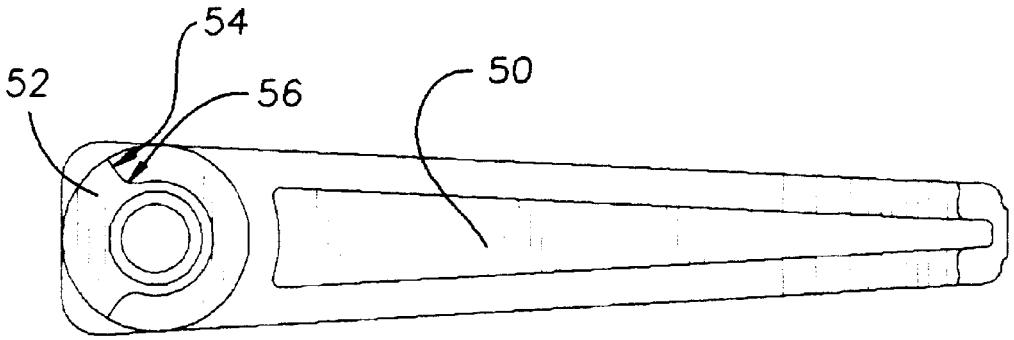
FIG. 5 is a plan view of the engagement side of the first handle showing the cam surface.

The mating surface 36 of one or more of the engagement pins or positioning levers 34 may also be operated by the second handle 60, said second handle 60 being mechanically connected to the shaft or second actuator assembly 40, which in turn is connected to the shaft collar assembly or second actuator 42. Said shaft collar assembly 42 is comprised of an inner surface 43 which in operation is in mechanical communication with the outer surface of shaft 40, and an outer surface 44 having a second cam or actuator surface 45. The second cam or actuator surface 45 engages one or more of the engagement pins 34 such that the latch bolt 30 within the latch assembly 10 may be operated by rotating the second handle 60, which causes the rotation of the cam or actuator surface 45 of the shaft collar assembly 42. FIG. 5 shows the latch bolt 30 forced into the second latch bolt position by the rotation of the second cam surface 45 of the shaft collar assembly 42.

Furthermore, said first handle 50 engages the latch bolt 30 directly, via the engagement of one or more of the engagement pins 34 by the first cam or actuator assembly 52 on the first handle 50, as describe above. This direct engagement entirely bypasses the shaft 40 and shaft collar assembly 42. The first handle 50, therefore, is capable of operating the latch bolt 30 even if the second handle 60 is locked or is otherwise restrained from being rotated.

One embodiment of the present invention further contains one or more slots or guidance tracks 24 in the latch housing 20 through which one or more of the engagement pins 34 extend. As illustrated in FIG. 1, as a result of such a configuration, the first cam or actuator assembly 52 may engage one or more of the engagement pins 34 of the latch bolt 30 entirely outside of the latch housing 20. This configuration, therefore, adds to the simple construction of the latch assembly 10. Moreover, this configuration offers ease of repair of the latch assembly 10, if necessary, and ease of replacing the first handle 50 with other handles or levers embodying different aesthetic outer designs or different functional configurations.

Another embodiment of the present invention comprises a pair of engagement pins 34 which are fixed to the latch bolt 30 and positioned relative to the first cam 52 such that the first cam 52 may engage one or both of the engagement pins 34 with an ease of motion in either the clockwise or the counter-clockwise direction. As shown in FIG. 2*a*, the two engagement pins 34 are positioned on opposite sides of the common axis of rotation of the first handle 50 and the shaft 40. The first camming or actuating surface 54 is thereby in communication with one or both of the engagement pins 34 nearly immediately upon rotating the first handle 50 in either the clockwise or the counter-clockwise direction. By rotating the first handle 50 in either direction, the first cam or actuator assembly 52 engages at least one of the engagement pins 34 causing the lateral structure 32 of latch bolt 30 to retract into the latch housing 20.

It is envisioned for this embodiment of the invention that the first camming or actuating surface 54 of the first handle 50 is progressively beveled to maximize the translation of the angular displacement of the first handle 50 to the lateral displacement of latch bolt 30. Similarly, the positioning levers 34 have mating surfaces 36 that are beveled accordingly to facilitate engagement by the first camming or actuating surface 54 and to maximize displacement of the latch bolt 30 thereby. It is contemplated that the mating surfaces 36 are beveled such that the mating surfaces 36 are substantially tangential to the common axis of rotation of the first handle 50 and the shaft collar assembly 42. FIG. 5 shows the first camming or actuating surface 54 of the first cam 52 envisioned for a preferred embodiment according this invention. Immediately upon rotating the first handle 50 the radially inward portion of camming surface 54 contacts the inward portion of the beveled mating surface 36 of one or the other engagement pins 34. As the first handle 50 is further rotated, the point of contact between the camming surface 54 and the mating surface 36 travels radially outwardly until the outermost edge of camming surface 54 is pressing on the outermost portion of beveled mating surface 36 of the engagement pin 34, or until the rotation of the first handle 50 is otherwise constrained.

This travelling radially outward of this point of contact maximizes the translation of the angular displacement of the first handle 50 to the lateral displacement of the latch bolt 30. Thus, the precise amount of bevel of the mating surfaces of the positioning levers 34 envisioned for this embodiment allow for sufficient lateral displacement of the latch bolt 30 such that there is no need for complicated gearing mechanisms or fulcrum structures. By avoiding such gearing mechanisms or fulcrum structures, the present invention can avoid the costly manufacture of the same and the accompanying risks associated with such additional components. A similar surface design is envisioned for the cam or actuator 45 of the shaft collar assembly 42 to maximize the lateral displacement of the latch bolt 30 due to the angular displacement of the second handle or release mechanism 60.

Furthermore, the camming or actuating surface 54 comprises a relatively tight curvature 56 at the radially inward portion of said camming surface, as does the cam or actuator 45 of the shaft collar assembly 42. This initial tight curvature 56 provides for nearly immediate contact with the mating surface 36 of one or the other positioning lever 34, thereby minimizing or eliminating the play otherwise encountered in such latch assembly mechanisms. The minimization of play in the latch assembly promotes a smoother operation for manipulating device or a smoother and more pleasing operation for the manual operator. It also results in greatly reducing the wear and tear on said latch assembly 10, resulting in turn in the improved longevity of the latch assembly.

While the present invention has been described with regards to particular embodiments, it is recognized that additional variations of the present invention may be devised without departing from the inventive concept.

What is claimed is:

1. A handle and latch assembly comprising:

a latch housing;

a latch bolt movably contained at least in part within said latch housing movable between a first latch bolt position and a second latch bolt position;

a biasing means for urging the latch bolt towards said first latch bolt position;

a first handle connected to said latch housing;

at least one engagement pin mounted to said latch bolt for engagement with at least said first handle;

a shaft in communication with said latch bolt;

a shaft collar assembly connected to said shaft and having a first camming surface for engaging the latch bolt or said at least one engagement pin; and a second handle connected to said shaft;

wherein said first handle comprises a second camming surface for engaging said at least one engagement pin.

2. A handle and latch assembly as claimed in claim 1, wherein said first handle is adapted to engage said latch bolt independently of said shaft and said shaft collar assembly.

3. A handle and latch assembly, comprising:

a latch housing having at least one slot;

a latch bolt movably contained at least in part within said latch housing movable between a first latch bolt position and a second latch bolt position;

at least one engagement pin mounted to said latch bolt and extending through said at least one slot in said latch housing;

a biasing means for urging the latch bolt towards said first latch bolt position;

a first handle connected to said latch housing and having a first cam surface adapted to engage said at least one engagement pin outside of said latch housing;

a shaft in communication with said latch bolt;

a second handle connected to said shaft;

and a shaft collar assembly connected to said shaft and having a second cam surface for engaging the latch bolt or said at least one engagement pin;

wherein said first handle is adapted to engage said latch bolt independently of said shaft and said shaft collar.

4. A closure mechanism having a closure brace comprising of a pair of brace halves that form at least one opening, and having a sliding member comprising a lateral structure, a catch structure, and one or more positioning levers, said lateral structure positioned either extending beyond said at least one opening or substantially retracted within said closure brace, said closure mechanism further comprising:

a biasing means for biasing the sliding member towards extending beyond said at least one opening in said closure mechanism;

a first release mechanism pivotally connected to said closure brace and having a first actuator assembly for adjustably positioning said one or more positioning levers; and a second release mechanism pivotally connected to said closure brace and having a second actuator assembly for adjustably positioning said one or more positioning levers in a manner operationally distinct from and independent of the first actuator assembly;

wherein said closure brace comprises one or more guidance tracks for said positioning levers; and wherein said one or more positioning levers have beveled surfaces adapted to be engaged by either said first or second actuator assembly, said beveled surface being dispose substantially tangentially to a common axis of rotation of said first and second actuator assemblies.

5. A handle and latch assembly, comprising:

a latch housing;

a latch bolt movably contained at least in part within said latch housing movable between a first latch bolt position and a second latch bolt position;

a biasing means for urging the latch bolt towards said first latch bolt position;

a first handle connected to said latch housing; and at least one engagement pin mounted to said latch bolt for engagement with at least said first handle;

wherein said first handle comprises at least one camming surface for engaging said at least one engagement pin; and wherein said at least one engagement pin has a beveled surface for facilitating the engagement by said at least one camming surface, said beveled surface being dispose substantially tangentially to a common axis of rotation of said first handle.

* * * * *